US009284757B2

(12) United States Patent
Kempel et al.

(10) Patent No.: US 9,284,757 B2
(45) Date of Patent: Mar. 15, 2016

(54) EMERGENCY RELEASE DEVICE FOR A VEHICLE TRUNK

(71) Applicant: Audi AG, Ingolstadt (DE)

(72) Inventors: Anton Kempel, Stuttgart (DE); Marco Ikker, Offenau (DE); Heiko Lowak, Buchen (DE)

(73) Assignee: AUDI AG, Ingolstadt (DE)

( * ) Notice: Subject to any disclaimer, the term of this patent is extended or adjusted under 35 U.S.C. 154(b) by 177 days.

(21) Appl. No.: 13/693,677

(22) Filed: Dec. 4, 2012

(65) Prior Publication Data

US 2013/0140831 A1 Jun. 6, 2013

(30) Foreign Application Priority Data

Dec. 5, 2011 (DE) ..... 10 2011 120 188

(51) Int. Cl.
*E05B 65/10* (2006.01)
*E05B 83/26* (2014.01)
(Continued)

(52) U.S. Cl.
CPC ..... *E05B 83/26* (2013.01); *E05B 77/54* (2013.01); *E05B 79/20* (2013.01); *E05B 81/08* (2013.01); *E05B 81/14* (2013.01); *E05B 83/24* (2013.01); *Y10T 292/0801* (2015.04)

(58) Field of Classification Search
CPC ..... E05B 83/26; E05B 83/24; E05B 65/108; E05B 77/54; E05B 79/20; E05B 81/08; E05B 81/14; Y10T 292/0908; Y10T 292/0911; Y10T 292/0801
USPC ..... 292/216, 92, 201, 251.5, DIG. 23, 292/DIG. 24, DIG. 42, DIG. 65, 95, 3
See application file for complete search history.

(56) References Cited

U.S. PATENT DOCUMENTS 3,580,623 A * 5/1971 Peters ..... E05B 81/20 292/201
3,917,327 A * 11/1975 Plasko ..... F03G 7/06 292/1

(Continued)

FOREIGN PATENT DOCUMENTS

DE 10224076 A1 * 12/2003
DE 10046189 B4 * 4/2004

(Continued)

OTHER PUBLICATIONS

Search report issued by the German Patent Office on Jul. 17, 2012.

*Primary Examiner* — Kristina Fulton
*Assistant Examiner* — Faria Ahmad
(74) *Attorney, Agent, or Firm* — Henry M. Feiereisen LLC

(57) ABSTRACT

An emergency release device for a trunk of a vehicle includes an arrestor device for limiting an opening movement of the trunk, a trunk lock and a coupling module including first and second coupling elements, each shiftably supported in the coupling housing, wherein the first and second coupling elements respectively operatively couple an emergency actuation device of the vehicle to the arrestor device, and an actuation device of the vehicle to the trunk lock, and are detachably coupled to each other during a first stroke of the first coupling element caused by an actuation of the emergency actuation device, wherein the first stroke causes the second coupling element to open the locking device and causes the first coupling element to perform an idle stroke relative to the arrestor device, and wherein the coupling between the first and second coupling elements is released in response to a second stroke advancing past the first stroke and is caused by the actuation of the emergency actuation device.

20 Claims, 3 Drawing Sheets

(51) Int. Cl.

| | |
|---|---|
| *E05C 3/04* | (2006.01) |
| *E05C 3/06* | (2006.01) |
| *E05C 17/56* | (2006.01) |
| *E05C 19/16* | (2006.01) |
| *E05B 77/54* | (2014.01) |
| *E05B 79/20* | (2014.01) |
| *E05B 81/08* | (2014.01) |
| *E05B 81/14* | (2014.01) |
| *E05B 83/24* | (2014.01) |

(56) References Cited

U.S. PATENT DOCUMENTS 4,102,213 A * 7/1978 Smith ..... E05B 77/48 292/144
4,331,353 A * 5/1982 Yazawa ..... F16C 1/101 292/28
RE31,899 E * 5/1985 Mochida ..... F16C 1/10 292/336.3
4,633,724 A * 1/1987 Mochida ..... E05B 53/005 296/76
4,702,094 A * 10/1987 Peterson ..... E05B 47/0603 180/289
4,858,971 A * 8/1989 Haag ..... E05B 77/48 292/201
4,869,351 A * 9/1989 Romano ..... B62L 1/16 188/2 D
4,886,307 A * 12/1989 Ruckert ..... 292/216
5,293,965 A * 3/1994 Nagano ..... B62L 1/14 188/2 D
5,348,355 A * 9/1994 Oyha ..... E05B 83/16 292/11
5,517,176 A * 5/1996 Lavelle ..... E05B 65/1046 292/92
5,525,963 A * 6/1996 Purssey ..... A62C 2/24 292/92
5,613,716 A * 3/1997 Cafferty ..... E05B 81/14 292/201
5,614,769 A * 3/1997 Kuroda ..... 307/10.2
5,638,721 A * 6/1997 Lee ..... F02D 11/04 123/319
5,829,314 A * 11/1998 Scura ..... B60T 11/06 188/24.11
6,102,454 A * 8/2000 Weyerstall ..... E05B 81/14 292/201
6,106,033 A * 8/2000 Ruckert ..... 292/216
6,123,372 A * 9/2000 Rogers et al. ..... 292/216
6,520,560 B2 * 2/2003 Schutt et al. ..... 296/121
6,546,763 B1 * 4/2003 Pielach ..... E05B 65/0014 292/315
6,779,372 B2 * 8/2004 Arlt ..... E05B 81/14 292/DIG. 23
6,831,376 B2 * 12/2004 Franke et al. ..... 307/10.1
6,879,058 B2 * 4/2005 Lorenz et al. ..... 307/10.1
7,063,360 B2 * 6/2006 Fukunaga et al. ..... 292/216
7,097,212 B2 * 8/2006 Willats et al. ..... 292/1
7,111,878 B2 * 9/2006 Kachouh ..... 292/216
7,222,459 B2 * 5/2007 Taniyama ..... 49/280
7,243,961 B2 * 7/2007 Fukunaga et al. ..... 292/216
7,261,335 B2 * 8/2007 Schupp ..... E05B 77/02 292/201
7,261,338 B2 * 8/2007 Spurr ..... E05B 81/20 292/201
7,281,748 B2 * 10/2007 Ruhlander et al. ..... 296/57.1
7,360,803 B2 * 4/2008 Parent et al. ..... 292/216
7,780,207 B2 * 8/2010 Gotou et al. ..... 292/336.3
7,823,741 B2 * 11/2010 Bridges et al. ..... 220/326
7,905,523 B2 * 3/2011 Stefanic et al. ..... 292/201
7,926,858 B2 * 4/2011 Otsuka ..... 292/216
8,047,584 B2 * 11/2011 Rock ..... 292/340
8,061,742 B2 * 11/2011 Machida et al. ..... 292/201
8,215,683 B2 * 7/2012 Drescher et al. ..... 292/216
8,303,004 B2 * 11/2012 Lee et al. ..... 292/216
8,348,310 B2 * 1/2013 Vazquez et al. ..... 292/217
8,376,416 B2 * 2/2013 Arabia et al. ..... 292/216
8,382,167 B2 * 2/2013 Kargilis ..... E05B 81/14 200/61.62
8,382,168 B2 * 2/2013 Carabalona et al. ..... 292/251.5
8,454,061 B2 * 6/2013 Spurr ..... 292/216
8,469,409 B2 * 6/2013 Plett ..... B62D 33/0273 292/201
8,573,658 B2 * 11/2013 Kim ..... B60R 21/34 292/201
8,579,068 B2 * 11/2013 Farooq ..... B60R 21/38 180/274
8,590,946 B2 * 11/2013 Cumbo et al. ..... 292/201
8,657,077 B2 * 2/2014 Tsai ..... B62L 1/14 188/196 M
8,798,858 B2 * 8/2014 Zysk ..... E05B 81/56 307/10.1
8,833,811 B2 * 9/2014 Ishikawa ..... E05B 17/106 292/336.3
2002/0000726 A1 * 1/2002 Zintler ..... 292/216
2002/0000727 A1 * 1/2002 Rass et al. ..... 292/216
2002/0050720 A1 * 5/2002 Helmer ..... 292/216
2002/0074809 A1 * 6/2002 Fisher ..... 292/216
2003/0080572 A1 * 5/2003 So ..... E05B 83/24 292/336.3
2005/0104382 A1 * 5/2005 Schupp ..... 292/201
2006/0028029 A1 * 2/2006 Spurr ..... 292/216
2006/0033346 A1 * 2/2006 Ala ..... 292/216
2007/0126243 A1 * 6/2007 Papanikolaou ..... E05B 81/06 292/201
2007/0138802 A1 * 6/2007 Stasko ..... E05B 81/14 292/201
2007/0216170 A1 9/2007 Drescher et al.
2007/0246944 A1 * 10/2007 Sundararajan ..... B60R 21/38 292/92
2009/0108595 A1 * 4/2009 De Vries ..... E05B 1/0038 292/215
2010/0032965 A1 * 2/2010 Kargilis et al. ..... 292/216
2011/0025077 A1 * 2/2011 Meyer et al. ..... 292/216
2011/0169281 A1 * 7/2011 Bender ..... E05B 83/16 292/216
2012/0019012 A1 * 1/2012 Saito ..... E05B 65/0858 292/68
2012/0161453 A1 * 6/2012 Zysk ..... E05B 83/24 292/21
2013/0049403 A1 * 2/2013 Fannon ..... E05B 83/24 296/193.11
2013/0140831 A1 * 6/2013 Kempel et al. ..... 292/3
2013/0238187 A1 * 9/2013 Zysk ..... 701/36
2014/0339834 A1 * 11/2014 Alexander et al. ..... 292/96

FOREIGN PATENT DOCUMENTS

| | | |
|---|---|---|
| DE | 103 59 737 A1 | 7/2005 |
| DE | 10 2006 012 062 A1 | 9/2007 |
| DE | 10 2007 029 679 A1 | 1/2009 |
| DE | 10 2007 052 771 A1 | 5/2009 |
| DE | 10 2010 056 413 A1 | 6/2012 |
| GB | 1 434 505 | 5/1976 |

* cited by examiner

EMERGENCY RELEASE DEVICE FOR A VEHICLE TRUNK

CROSS-REFERENCES TO RELATED APPLICATIONS

This application claims the priority of German Patent Application, Serial No. 10 2011 120 188.6, filed Dec. 5, 2011, pursuant to 35 U.S.C. 119(a)-(d), the disclosure of which is incorporated herein by reference.

BACKGROUND OF THE INVENTION

The invention relates to an emergency release device for a vehicle trunk of a vehicle.

The following discussion of related art is provided to assist the reader in understanding the advantages of the invention, and is not to be construed as an admission that this related art is prior art to this invention.

With an emergency release device such as disclosed in DE 10 2006 012 062 A1, a person who is trapped in a front side trunk of a vehicle can free herself by actuating an emergency release device for release of the front hood. An emergency release system is for example mandated according to a US provision FMVSS 401 for the vehicle market in the United State of America.

The known emergency release device according to DE 10 2008 012 062 A1 relates to a locking device for a front hood of a motor vehicle with a rotary latch which interacts with a lid side locking arm, which rotary latch is securely held in a locked position by means of a ratchet and with a arrestor hook which can be brought in engagement with a catch element after moving the ratchet in an open position, through which arrestor hook the hood can be held in a holding position, wherein the arrestor hook can be moved from the holding position into an open position in which the lid can be completely opened.

In this known locking device, the rotary latch and the arrestor hook are configured as separate parts, so that the ratchet of the rotary latch and the arrestor hook can be successively actuated via a common Bowden cable.

With this known emergency release device it is supposed to be possible to easily also actuate the arrestor hook via the Bowden cable, with which the ratchet of the rotary latch is moved in to a releasing open position.

For this, the strand of the Bowden cable is connected with the ratchet and its sheath with the arrestor hook of the trap device, wherein the sheath of the Bowden cable is held fixed in position on the arrestor hook, while its strand which is connected to the ratchet is moved relative to the sheath or the arrestor hook. After the ratchet is moved into its open position by the movement of the strand the sheath can in a second step be moved relative to the strand and according a movement of the arrestor hook into its open position results.

Further, a locking device which is formed by an electromagnet is provided in this known emergency release device, with which the actuation of the arrestor hook can be prevented in dependence on the driving speed of the motor vehicle.

It would be desirable and advantageous to provide an improved emergency release device of the aforementioned type.

SUMMARY OF THE INVENTION

According to one aspect of the present invention, an emergency release device for a trunk of a vehicle, includes a locking device, an arrestor device limiting an opening movement of the trunk, wherein the arrestor device includes an arrestor hook for reversing said limiting, an emergency actuation device arranged in the trunk and being operatively connected to the arrestor device and the locking device, wherein the emergency actuation device when actuated successively opens the locking device and releases the arrestor device, an actuation device, and a coupling module including a coupling housing, and first and second coupling elements shiftably supported in the coupling housing, wherein the first coupling element operatively couples the emergency actuation device to the arrestor device, wherein the second coupling element operatively couples the actuation device to the locking device, wherein during a first stroke of the first coupling element caused by an actuation of the emergency actuation device, the first and second coupling elements are releasably coupled to each other, wherein the first stroke causes the second coupling element to open the locking device, and is an idle stroke in relation to the arrestor device, and wherein in response to a second stroke, caused by the actuation of the emergency actuation device and extending past the first stroke, the first and second coupling elements are released from each other, and the first coupling element releases the arrestor device.

In this solution according to the invention, a sequential opening of the locking device of the trunk and the release of the arrestor device also occurs according to the known emergency release device according to DE 10 2006 012 A1, however, the actuating forces which have to be exerted on the emergency release device are significantly smaller because after a first stroke, which only leads to the opening of the trunk lock, the second coupling element is de-coupled and thus only a force for the release of the arrestor device is required for the further actuation.

According to another advantageous feature of the invention, the coupling housing further includes a holding magnet, wherein upon completion of the second stroke an anchor plate of the holding magnet is connected with the first coupling element and rests against the holding magnet. This achieves a latching engagement of the arrestor device in the open state, thereby preventing a reengagement for example of an arrestor hook with an associated catch element.

According to another advantageous feature of the invention, second coupling element has a pivotally supported coupling lever which is spring loaded in a direction of the first coupling element. This represents a simple mechanical solution for such a coupling between the two coupling elements. For this purpose, the first coupling element preferably has a detent nose for coupling with the second coupling element, with the end of the coupling lever engaging behind the detent nose, wherein the coupling housing is configured with a stop which at the beginning of the second stroke of the first coupling element causes a pivoting of the coupling lever out of its engagement behind the detent nose of the first coupling element.

According to another advantageous feature of the invention, an actuation of the actuation device causes a shifting of the second coupling element in the coupling housing independent of the first coupling element for opening the locking device.

This is advantageously achieved according to a refinement in that the shifting of the second coupling element causes a pivoting back of the coupling lever for de coupling from the first coupling element in that the end of the coupling lever slides along the first coupling element and the stop of the coupling housing.

According to another advantageous feature of the invention, the first coupling element is connected by non positive engagement with the arrestor device via a pulling-force transmitting pulling means, preferably a Bowden cable.

According to another advantageous feature of the invention, the first coupling element is pre-tensioned in the coupling housing by a spring element in a direction of a pulling force defined by the emergency release device.

Particularly advantageous is when in an embodiment of the invention the holding magnet is configured as electromagnet and is supplied with current in dependence on the speed of the vehicle, in order to cause a falling off of the anchor plate from the holding magnet and to cause a shifting of the first coupling element into its starting position as a result of the pretension of the spring element. This allows bringing an arrestor hook again into its catch position when at released arrestor device the vehicle starts driving and exceeds a predetermined speed.

In addition, for reasons of safety it is also provided according to a refinement of the invention, to configure the coupling housing with an electrically actuatable locking element which in dependence on the speed of the vehicle prevents a shifting of the first coupling element past the first stroke.

According to another advantageous feature of the invention, the first coupling element is connected by non positive engagement with the arrestor device via a pulling-force transmitting pulling means, and the second coupling element is connected by non positive engagement with the actuation device via a pulling-force transmitting pulling means According to another advantageous feature of the invention, the second coupling element is configured for non engaging movement in relation to the pulling-force transmitting pulling means by virtue of coupling to the first stroke According to another advantageous feature of the invention, the second coupling element is connected by non positive engagement with the trunk lock via a pulling-force transmitting pulling means.

As pulling means, a Bowden cable with a pulling grope and a pulley sleeve can be used for the emergency release device according to the invention.

According to another advantageous feature of the invention, for forming the idle stroke, an end of the pulling cable is provided with a cable nipple which is supported in an oblong groove which extends in a pulling direction of the pulling means for shifting along a length which corresponds to an extent of the idle stroke.

BRIEF DESCRIPTION OF THE DRAWING

Other features and advantages of the present invention will be more readily apparent upon reading the following description of currently preferred exemplified embodiments of the invention with reference to the accompanying drawing, in which.

DETAILED DESCRIPTION OF PREFERRED EMBODIMENTS

Figure 1:
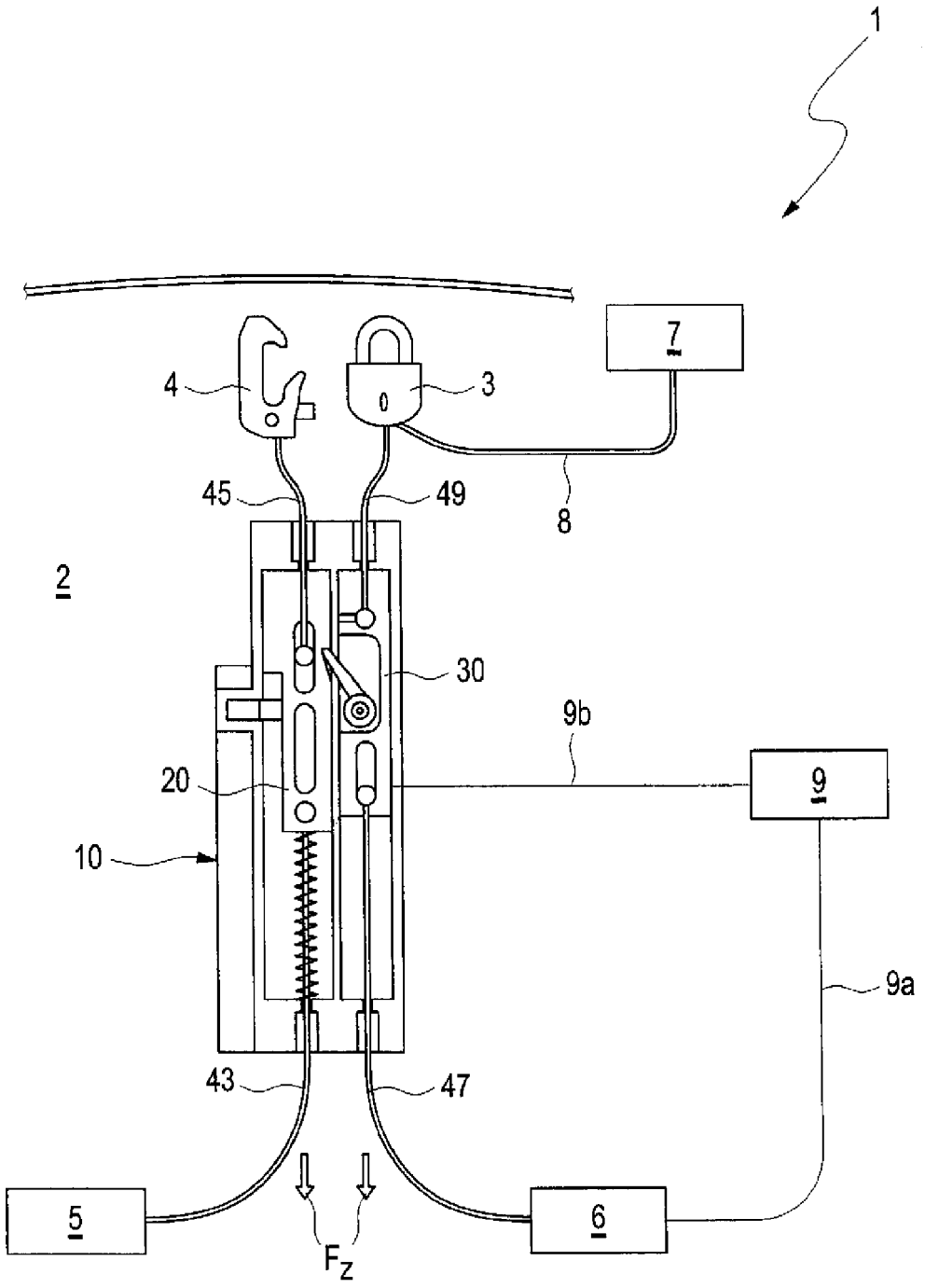
FIG. 1 shows a schematic representation of an emergency release device with a coupling module as exemplary embodiment according to the invention.

Throughout all the Figures, same or corresponding elements are generally indicated by same reference numerals. These depicted embodiments are to be understood as illustrative of the invention and not as limiting in any way. It should also be understood that the drawings are not necessarily to scale and that the embodiments are sometimes illustrated by graphic symbols, phantom lines, diagrammatic representations and fragmentary views. In certain instances, details which are not necessary for an understanding of the present invention or which render other details difficult to perceive may have been omitted.

Turning now to the drawing, and in particular to FIG. 1, there is shown an emergency release device 1 for a front hatch of a vehicle for example a motor vehicle and includes as central element a coupling module 10, which by means of pulling means which are configured as Bowden cables 43, 45, 47, 49 form an operative connection between an emergency release device 5 arranged in a trunk 2 of the vehicle and an actuation device 6 on the one hand, and on the other hand with a trunk lock 3 and a arrestor device 4, schematically indicated as lock and arrestor hook. A person which is trapped in the trunk can open the trunk lock 3 by actuating the emergency release device 5 and release the arrestor device 4, so that the front hatch can be fully opened and the trapped person can free herself from this trunk.

The construction and the function of such a trunk lock 3 is known which for example consists from a vehicle side lock trap and a hatch side locking part. For opening the trunk lock 3, the lock trap is connected by means of a manually actuatable release device 7 which is arranged in the passenger compartment of the vehicle, as for example shown in FIG. 1. The release of the trunk lock 3 can also be caused electrically by a control device 9 of the vehicle by its actuation of its actuation device 6 which is configured as actuator. For this, the control device 6 is connected to this electric lock release device 6 via a data line 9*a*. The opening of the trunk lock 3 is in this case caused by a control element which is arranged in the passenger compartment.

The construction and the function of a arrestor device 4 are also known and are formed for example by a hood-side arrestor hook and a corresponding vehicle-side arrestor element. The arrestor hook engages behind the arrestor element and thereby prevents an opening of the front hood which extends past a small initial opening. In order to remove the movement limitation the arrestor hook is actuatable from outside the trunk via a corresponding mechanic. The transition of the arrestor hook from its opening-limiting position into its open position is for example caused by means of an arrestor hook lever which is connected to the emergency release device 5, as for example described in the previously mentioned DE 10 2006 012 062 A1.

Figure 2:
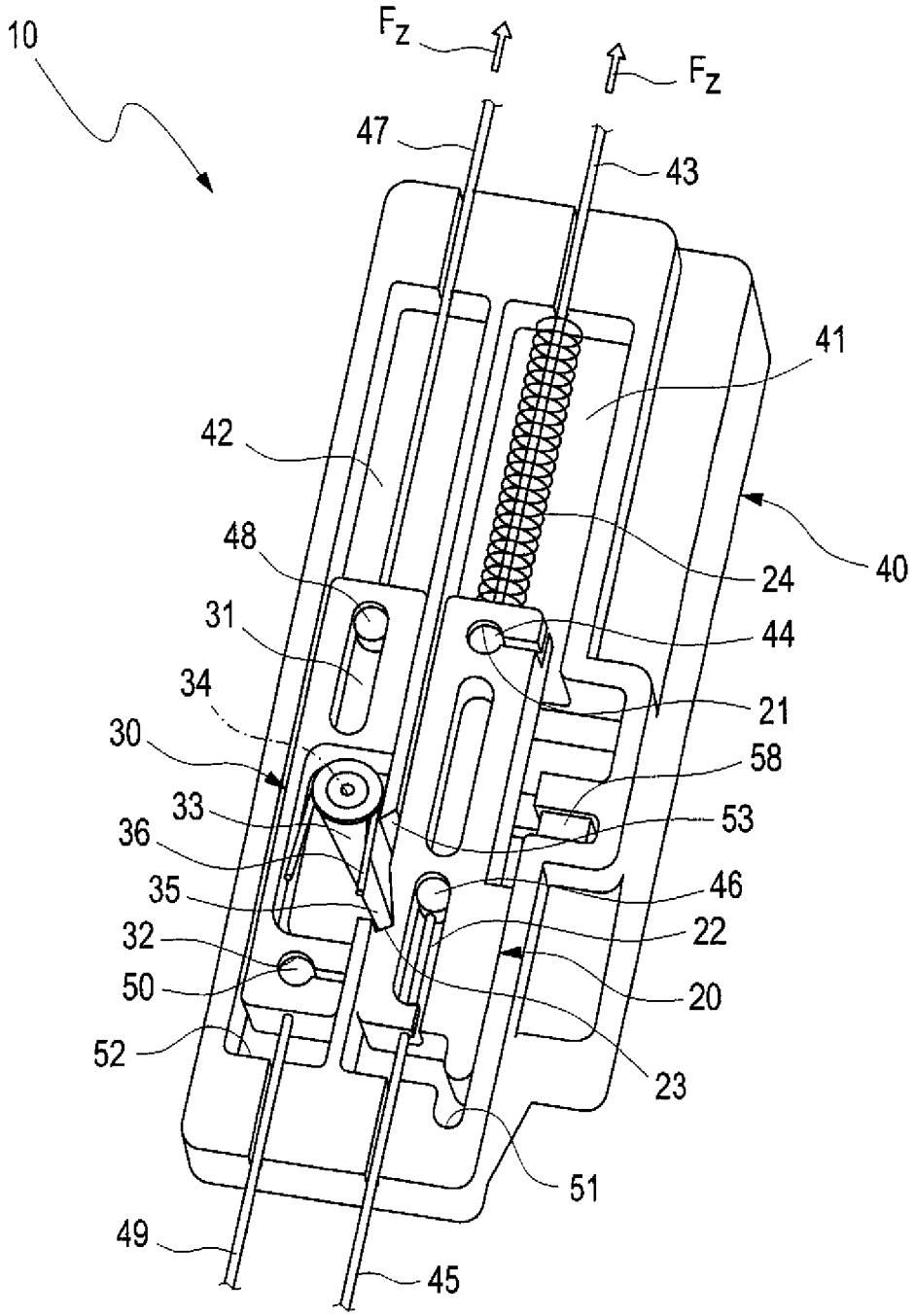
FIG. 2 shows a schematic representation of the coupling module according to FIG. 1 in an open front view.

In combination, FIGS. 1 and 2 show the construction of the coupling module 10 from a first coupling element 20 and a second coupling element 30, when the first and second coupling element 20 or 30 are arranged in a coupling housing 40.

For receiving these longitudinal and square shaped coupling elements 20 and 30 in this coupling housing 40 the coupling housing 40 is configured with two longitudinal chambers 41 and 42 which are adjusted to the shape of the coupling elements 20 and 30, in which chambers 41, 42 a coupling element 20 or 30 is supported for shifting in longitudinal direction x.

The first coupling element 20 is connected by none positive engagement to the emergency release device 5 via the pulling rope of the Bowden cable 43 and with its other end connected by none positive engagement to the arrestor device 4 also via the pulling rope of the further Bowden cable 45. With this, the two Bowden cables 43 and 45 together with the first coupling element 20 form a pulling force transmission path between the emergency actuation device 5 and the arrestor device 4. Further, the first coupling element 20 is pre-tensioned in a pulling direction $F_z$ by means of a return spring 24.

The end of the pulling rope of the Bowden cable 43 or 45 is formed by a spherical rope nipple 44 or 46. The rope nipple 44 of the Bowden cable 43 is received by a nipple receptacle 21 of the first coupling element which nipple receptacle is shaped corresponding to the spherical shape of the rope nipple 44 and fixed, while the rope nipple 46 of the Bowden cable 45 is supported in a nipple receptacle 22 of the coupling element 20 which nipple receptacle 22 is configured as longitudinal groove, for shifting in this longitudinal groove over the length of this longitudinal groove. This support of the rope nipple 46 in this longitudinal groove 22, enables an idle stroke by the first coupling element 20 in relation to the arrestor device 4 corresponding to the length of the longitudinal groove 22.

The second coupling element 30 is connected with the actuation device 6 with one of its ends via the pulling cable of the Bowden cable 47, in that a spherical cable nipple 48 of the pulling cable is supported in a nipple receptacle 31 which is configured as oblong groove, for shifting along this oblong groove, wherein the length of this oblong groove 31 essentially corresponds to the length of the oblong groove 22 of the first coupling element 20. The other end of the second coupling element 30 is connected with the trunk lock 3 via the pulling cable of the Bowden cable 49, wherein also in this case, a spherical rope nipple 50 of the end of the pulling rope of this Bowden cable 49 is received by a nipple receptacle 32 which is adapted to the spherical shape of the rope nipple 50, and fixed in this second coupling element 30. The two Bowden cables 47 and 49 together with the second coupling element 30 also form a pulling force transmission path between the actuation device 6 and the trunk lock 3.

The first and second coupling elements 20 and 30 are shown in the coupling module 10 according to FIG. 2 in their starting position, in which the trunk lock 3 is closed and the arrestor device 3 is in a none actuated position. In this position, the first and second coupling element 20 30 respectively rest against the end sides 51 and 52 of the two chambers 41 and 42 through which end sides 51, 52 the two Bowden cables 45 and 49 are guided to the trunk lock 3 and the arrestor device 4. Due to the return spring 24, the first coupling element 20 is constantly pushed in the direction of its starting position shown in FIG. 2 during a shifting movement in the direction of the pulling force $F_z$.

The second coupling element 30 is configured with a coupling lever 33 which is pivotal about a pivot axis 34 and which is pre-tensioned in the direction of the first coupling element 20 by means of a shank spring 36, wherein the pivot axis 34 is arranged so that in the positions shown in FIG. 2, the first and second coupling elements 20 and 30 the end 35 of the coupling lever 33 is supported against a detent nose 23 of the first coupling element in thereby coupled to the first coupling element in such a manner that in case of a movement of the first coupling element 20 in x-direction, i.e. in pulling direction $F_z$ with regard to the emergency actuation device, the second coupling element 30 is moved along.

In the following, the function of the first and second coupling elements 20 and 30 when actuating the emergency actuation device 5 and the actuation device 6 is explained.

When actuating the emergency actuation device 5, the pulling force $F_z$ generated thereby is transferred to the first coupling element 20 and due to the coupling with the second coupling element 30 also to the second coupling element 30, whereby the trunk lock 3 is opened. The shift required therefore referred to as first stroke, determines the position of a stop 53 of the coupling housing 40 for the coupling lever 33 of the second coupling element 30. This stop 53 causes the coupling lever 33 which is pre-tensioned by the shank spring 36, to be pivoted out of the detent nose at the end of the first stroke due to a further shifting movement of the first coupling element 20, so that the second coupling element 30 is decoupled from the first coupling element 20 and thus does not carry out any further shifting movements.

During the first stroke of the first coupling element 20 the latter carries out an idle stroke relative to the Bowden cable 45, because the rope nipple 46 of the first coupling element is supported in the oblong groove 22 and therefore moves relative to the first coupling element 20 from an end of the oblong groove 22 as far as an opposing end of the oblong groove 22 and rests against the opposing end, so that a pulling force which is generated in a further sequence of movement is also transferred to the pulling rope of the Bowden cable 45.

As a result, the rope nipple 46 of the Bowden cable 45 is carried along by the first coupling element 20 past the first stroke via a shifting movement of the second stroke of the first coupling element 20 and thereby the movement transferred to a arrestor hook of the arrestor device 4, so that thereby at the end of the second stroke, the opening movement of the front hood of the trunk 2 is enabled.

Figure 3:
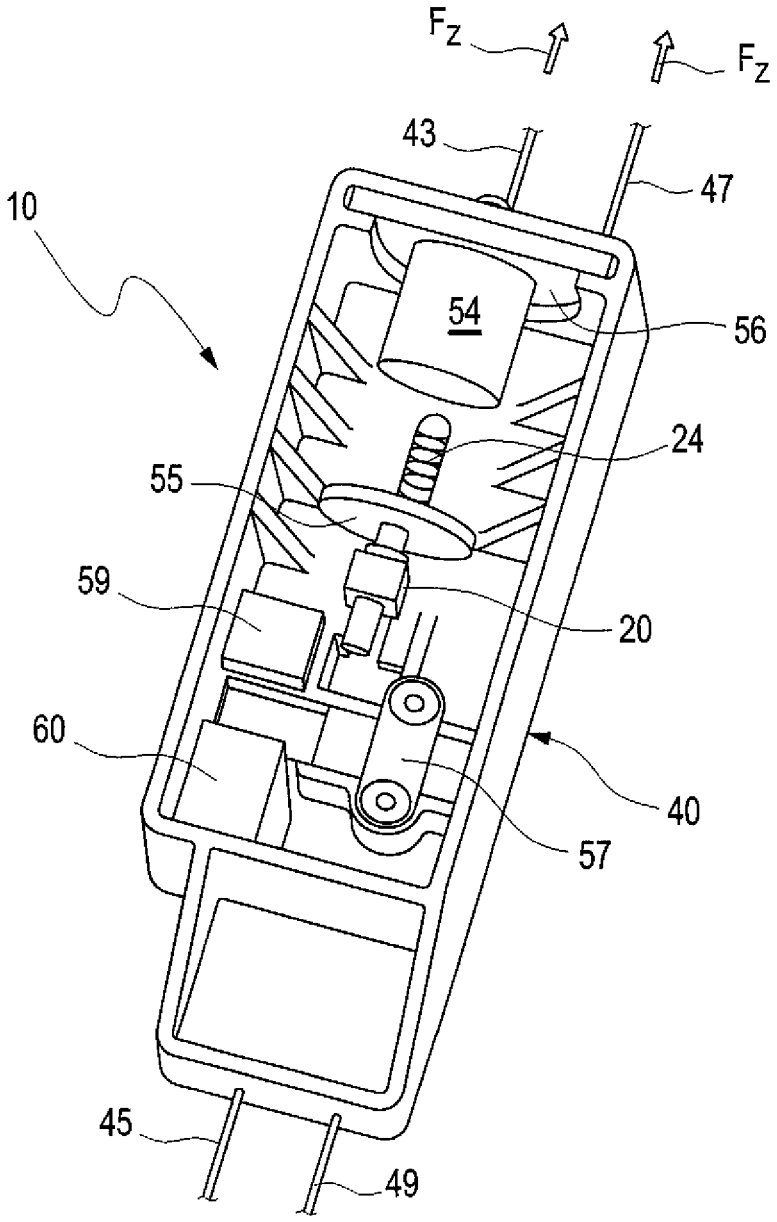
FIG. 3 shows a schematic representation of the coupling module according to FIG. 1 in an open rear view.

After the first coupling element 20 has reached its maximal stroke which is formed by the first and second stroke, an anchor plate 55 of a permanent magnet 54, which anchor plate 55 is connected with the first coupling element 20 rests against the permanent magnet 54 (see FIG. 3) whereby the arrestor device 4 remains released, i.e. the arrestor hook of such an arrestor device 4 remains in the open state. The front hood of the trunk 2 can be opened. For verifying the function of the state of the arrestor device 4 a micro switch 60 (see FIG. 3) is provided which is mounted in the coupling housing 40, and detects the position of the first coupling element 20.

The permanent magnet 54 is configured as electromagnet and mounted in the coupling housing with a mounting plate 56; it is capable to hold the anchor plate 55 when not supplied with current. Only a short current pulse is sufficient to repel the anchor plate with the support of the return force of the pre-tensioned return spring 24. This is used to briefly supply this permanent magnet 54 with current in the state of the released arrestor device 4 when the vehicle starts driving and exceeds a predetermined speed for example 5 km/h as required in the US-Provision FMVSS 401. This automatically causes the arrestor device assumes its starting position, in which its arrestor hook limits the opening movement of the front hatch of the vehicle.

For this, sensor signals of rotational speed sensor of the vehicle are provided to the control device 9 and via a data line this permanent magnet 54 controlled.

Further, a stroke magnet 57 which is configured as electromagnet is integrated in the coupling housing 40 together with a ratchet 58 (see FIGS. 2 and 3), which blocks the movement of the first coupling element after its first stroke. In case an actuation of the emergency actuation device 5 is terminated in this state, the first coupling element 20 is pushed into its starting position by the return force of the return spring 24. Also for this the control device analyses sensor signals of rotational speed sensors of the vehicle and controls the stroke magnet 57 via the data line **9*b*, which stroke magnet is configured as bi-stable stroke magnet. This has the advantage that the stroke magnet is not supplied with current in both positions and supply with current is only required for the change from one position into another. In order to detect the position of the stroke magnet 57, a function monitoring by means of a micro switch which is arranged in the coupling housing 40** can be carried out.

The usual procedure for opening the trunk lock 3 is that the actuation device 6 which is configured as electric lock release, is controlled by the control device 9, by which a corresponding pulling force $F_z$ is transferred to the second coupling element 30 and the Bowden cable 49 and as a result the second coupling element 30 is shifted in the direction of the pulling force $F_z$. During this movement, the coupling lever 33 is pivoted out of the position in which it rests against the first coupling element 20, because the end 35 of the coupling lever 33 first slides along the first coupling element 20 and then along the stop 53, without influencing the second coupling element 20.

While the invention has been illustrated and described in connection with currently preferred embodiments shown and described in detail, it is not intended to be limited to the details shown since various modifications and structural changes may be made without departing in any way from the spirit of the present invention. The embodiments were chosen and described in order to best explain the principles of the invention and practical application to thereby enable a person skilled in the art to best utilize the invention and various embodiments with various modifications as are suited to the particular use contemplated.

What is claimed as new and desired to be protected by Letters Patent is set forth in the appended claims and includes equivalents of the elements recited therein:

1. An emergency release device for a trunk of a vehicle, comprising:

a locking device;

an arrestor device limiting an opening movement of the trunk, said arrestor device including an arrestor hook for reversing said limiting;

an emergency actuation device arranged in the trunk and being operatively connected to the arrestor device and the locking device, said emergency actuation device when actuated successively opening the locking device and releasing the arrestor device;

an actuation device; and a coupling module including a coupling housing, and first and second coupling elements shiftably supported in the coupling housing, said first coupling element operatively coupling the emergency actuation device to the arrestor device, said second coupling element operatively coupling the actuation device to the locking device, wherein during a first stroke of the first coupling element caused by an actuation of the emergency actuation device, the first and second coupling elements are releasably coupled to each other, wherein the first stroke causes the second coupling element to open the locking device, and is an idle stroke in relation to the arrestor device, and wherein in response to a second stroke of the first coupling element, caused by the actuation of the emergency actuation device and extending past the first stroke, the first and second coupling elements are decoupled from each other so that the first coupling element is moved by the emergency actuation device independent of the second coupling element, and the first coupling element releases the arrestor device.

2. The emergency release device of claim 1, wherein the coupling housing further includes a holding magnet, and wherein upon completion of the second stroke an anchor plate of the holding magnet is connected with the first coupling element and rests against the holding magnet.

3. The emergency release device of claim 2, wherein the holding magnet is constructed as permanent holding magnet.

4. The emergency release device of claim 1, wherein the second coupling element has a pivotally supported coupling lever which is spring loaded in a direction of the first coupling element.

5. The emergency release device of claim 4, wherein the first coupling element has a detent nose, wherein the first and second coupling elements are coupled to each other by engagement of an end of the coupling lever behind said detent nose, and wherein the coupling housing includes a stop which at initiation of the second stroke of the first coupling element causes the coupling lever to pivot out of the detent nose.

6. The emergency release device of claim 1, wherein an actuation of the actuation device causes a shifting of the second coupling element in the coupling housing independent of the first coupling element for opening the locking device.

7. The emergency release device of claim 5, wherein an actuation of the actuation device causes a shifting of the second coupling element in the coupling housing independent of the first coupling element for opening the locking device, and wherein the shifting of the second coupling element in the coupling housing causes the coupling lever to pivot backwards as a result of sliding of the coupling lever along the first coupling element and the stop, thereby decoupling the second coupling element from the first coupling element.

8. The emergency release device of claim 1, wherein the first coupling element is connected to the emergency actuation device by a pulling means for transmitting a pulling force.

9. The emergency release device of claim 1, wherein the first coupling element is pre-tensioned in the coupling housing by a spring element in a direction of a pulling force defined by the emergency release device.

10. The emergency release device of claim 2, wherein the holding magnet is constructed as electromagnet and is supplied with current as a function of a driving speed of the vehicle, said current causing the anchor plate to detach from the holding magnet and a pre-tension of the spring element causing a shifting of the first coupling element into a starting position.

11. The emergency release device of claim 1, wherein the coupling housing further includes an electrically actuatable arresting element which prevents a shifting of the first coupling element past the first stroke as a function of a speed of the vehicle.

12. The emergency release device of claim 1, wherein the first coupling element is connected by non positive engagement with the arrestor device via a pulling-force transmitting pulling means.

13. The emergency release device of claim 1, wherein the second coupling element is connected by non positive engagement with the actuation device via a pulling-force transmitting pulling means.

14. The emergency release device of claim 12; wherein the second coupling element is configured for non engaging movement in relation to the pulling-force transmitting pulling means during the first stroke.

15. The emergency release device of claim 1, wherein the second coupling element is connected by non positive engagement with the locking device via a pulling-force transmitting pulling means.

16. The emergency release device of claim 12, wherein the pulling means is configured as Bowden cable including a pulling cable and a cable sleeve.

17. The emergency release device of claim 13, wherein the pulling means is configured as Bowden cable including a pulling cable and a cable sleeve.

18. The emergency release device of claim 14, wherein the pulling means is configured as Bowden cable including a pulling cable and a cable sleeve.

19. The emergency release device of claim 15, wherein the pulling means is configured as Bowden cable including a pulling cable and a cable sleeve.

20. The emergency release device of claim 19, wherein for forming the idle stroke an end of the pulling cable is provided with a cable nipple which is supported in an oblong groove which extends in a pulling direction of the pulling means for shifting along a length which corresponds to an extent of the idle stroke.

* * * * *